US008876246B2

(12) United States Patent
Sakai et al.

(10) Patent No.: US 8,876,246 B2
(45) Date of Patent: Nov. 4, 2014

(54) LIQUID EJECTING APPARATUS, METHOD OF CONTROLLING LIQUID EJECTING APPARATUS, AND PROGRAM FOR CONTROLLING LIQUID EJECTING APPARATUS

(75) Inventors: Hirofumi Sakai, Shiojiri (JP); Mitsuhiro Yamashita, Matsumoto (JP); Seishin Yoshida, Azumino (JP); Hirohisa Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 86 days.

(21) Appl. No.: 13/611,448

(22) Filed: Sep. 12, 2012

(65) Prior Publication Data

US 2013/0063516 A1 Mar. 14, 2013

(30) Foreign Application Priority Data

Sep. 12, 2011 (JP) ..... 2011-197982

(51) Int. Cl.
*B41J 29/393* (2006.01)
*B41J 29/38* (2006.01)

(52) U.S. Cl.
CPC ..... *B41J 29/38* (2013.01); *B41J 29/393* (2013.01)
USPC ..... 347/19; 347/9; 347/14

(58) Field of Classification Search
CPC .... B41J 2/04558; B41J 2/04573; B41J 2/195; B41J 2/20; B41J 2/2107; B41J 2/11; B41J 2/2117; B41J 29/393; B41J 2/0451; B41J 2/2142; B41J 2/16579; B41J 2/04571
See application file for complete search history.

(56) References Cited

U.S. PATENT DOCUMENTS

| | | | |
|---|---|---|---|
| 2003/0149130 A1 | 8/2003 | Kondo | |
| 2011/0007318 A1 | 1/2011 | Okuda et al. | |

FOREIGN PATENT DOCUMENTS

| | | | | |
|---|---|---|---|---|
| JP | 2003-182061 A | | 7/2003 | |
| JP | 2005-161660 | * | 6/2005 | ..... B41J 2/18 |
| JP | 2005-161660 A | | 6/2005 | |
| JP | 2007-161847 A | | 6/2007 | |
| JP | 2011-016883 A | | 1/2011 | |

* cited by examiner

*Primary Examiner* — Juanita D Jackson
(74) *Attorney, Agent, or Firm* — Nutter McClennen & Fish LLP; John J. Penny, Jr.; Joshua L. Rudawitz

(57) ABSTRACT

A printer as an ink ejecting apparatus capable of ejecting sedimentation ink includes an LED as a first light emitting unit that emits light to a patch as a measurement target portion printed on a printing medium by the sedimentation ink, a light receiving sensor as a first light receiving unit that receives light transmitted from the LED and passing through the patch, and a control unit as a shielding degree determining unit that determines whether or not the patch has a predetermined shielding degree on the basis of a light reception signal output from the light receiving sensor.

7 Claims, 10 Drawing Sheets

LIQUID EJECTING APPARATUS, METHOD OF CONTROLLING LIQUID EJECTING APPARATUS, AND PROGRAM FOR CONTROLLING LIQUID EJECTING APPARATUS

BACKGROUND

1. Technical Field

The present invention relates to a liquid ejecting apparatus, a method of controlling the liquid ejecting apparatus, and a program for controlling the liquid ejecting apparatus.

2. Related Art

For example, as disclosed in JP-A-2005-161660, an ink ejecting apparatus capable of ejecting ink containing a component that becomes sedimented with the lapse of time is known. In the ink ejecting apparatus, in order to predict whether or not the component of the ink in an ink tank is in a sedimentation state, a patch is printed, a color of the printed patch portion is measured, and it is predicted whether or not the sedimentation state is present in the ink on the basis of the result thereof.

However, although the result of the color measurement represents that the sedimentation state of the ink does not occur, there is a case where the sedimentation state has occurred in the ink in the ink ejecting apparatus. That is, there is a case where the result of the color measurement does not accurately reflect occurrence or nonoccurrence of the sedimentation state.

SUMMARY

An advantage of some aspects of the invention is to provide a liquid ejecting apparatus capable of more reliably detecting whether or not a sedimentation state occurs in a liquid in which a component contained in the liquid ejecting apparatus is sedimented with the lapse of time.

According to an aspect of the invention, there is provided a liquid ejecting apparatus that ejects a liquid in which a contained component is sedimented with the lapse of time, the liquid ejecting apparatus including: a first light emitting unit that emits light to a measurement target portion on a printing medium; a first light receiving unit that receives light emitted from the first light emitting unit and passing through the measurement target portion; and a shielding degree determining unit that determines a shielding degree of the measurement target portion on the basis of the first light receiving unit.

With such a configuration of the liquid ejecting apparatus, it is possible to determine whether or not the measurement target portion has a predetermined shielding degree.

In the liquid ejecting apparatus, the first light emitting unit may be disposed on a side separated further from the printing medium than a platen surface.

With such a configuration of the liquid ejecting apparatus, it is possible to prevent the printing medium transported on the platen from coming in contact with the first light emitting unit.

The liquid ejecting apparatus may further include: a carriage moving unit that moves a carriage in a direction in which a distance from the printing medium is changed, a liquid ejecting head being mounted on the carriage; and a light shielding unit that reduces incidence of light to the first light receiving unit other than the light output from the first light emitting unit, wherein the first light receiving unit is mounted on the carriage.

In the liquid ejecting apparatus, the first light receiving unit may be provided with the light shielding unit, it is possible to prevent light (ambient light) other than the light output from the first light emitting unit from being input to the first light receiving unit, and thus it is possible to improve precision in measurement of the shielding degree. The carriage moving unit is provided, the carriage is provided with the first light receiving unit, it is possible to shorten the distance between the first light receiving unit and the first light emitting unit, and thus it is possible to further prevent ambient light from being input to the first light receiving unit.

The liquid ejecting apparatus may further include a sedimentation dissolution unit that dissolves a sedimentation of the liquid on a flow path from a liquid tank storing the liquid to a liquid ejecting head that ejects the liquid, wherein the sedimentation dissolution unit is driven according to the determination result of the shielding degree determining unit.

With such a configuration, when the sedimentation state occurs in the liquid in which the contained component is sedimented with the lapse of time, it is possible to dissolve the sedimentation state.

The liquid ejecting apparatus may further include: a second light emitting unit that emits light from a printing face side to the measurement target portion; a second light receiving unit that receives the light emitted from the second light emitting unit and reflected from the measurement target portion; and a gloss degree determining unit that determines a gloss degree of the measurement target portion on the basis of the second light receiving unit.

With such a configuration of the liquid ejecting apparatus, it is possible to determine whether or not the sedimentation state occurs in the liquid in which the contained component is sedimented with the lapse of time on the basis of the gloss degree.

According to another aspect of the invention, there is provided a method of controlling a liquid ejecting apparatus that ejects a liquid in which a contained component is sedimented with the lapse of time, the method including: printing a measurement target portion on a printing medium by the liquid; and determining a shielding degree of the measurement target portion on the basis of the amount of light emitted to the measurement target portion where the liquid is printed that passes through the measurement target portion.

With such a control of the liquid ejecting apparatus, it is possible to determine whether or not the measurement target portion has a predetermined shielding degree. When the measurement target portion does not have the predetermined shielding degree, the operation of dissolving the sedimentation state is performed. For this reason, when the sedimentation state occurs in the liquid, it is possible to dissolve the sedimentation state.

According to still another aspect embodiment of the invention, there is provided a program for controlling a liquid ejecting apparatus ejecting a liquid in which a contained component is sedimented with the lapse of time, the program including: printing a measurement target portion on a printing medium by the liquid; and determining a shielding degree of the measurement target portion on the basis of light passing through the measurement target portion where the liquid is printed.

With such a configuration of the program for controlling the liquid ejecting apparatus, it is possible to determine whether or not the measurement target portion has a predetermined shielding degree. When the measurement target portion does not have the predetermined shielding degree, the operation of dissolving the sedimentation state is performed.

For this reason, when the sedimentation state occurs in the liquid, it is possible to dissolve the sedimentation state.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, an example of embodiments of the invention will be described with reference to the drawings. A method of controlling a liquid ejecting apparatus and a program for controlling a liquid ejecting apparatus will be described with a configuration and an operation of the liquid ejecting apparatus.

Overall Configuration of Printer 1

Figure 1:
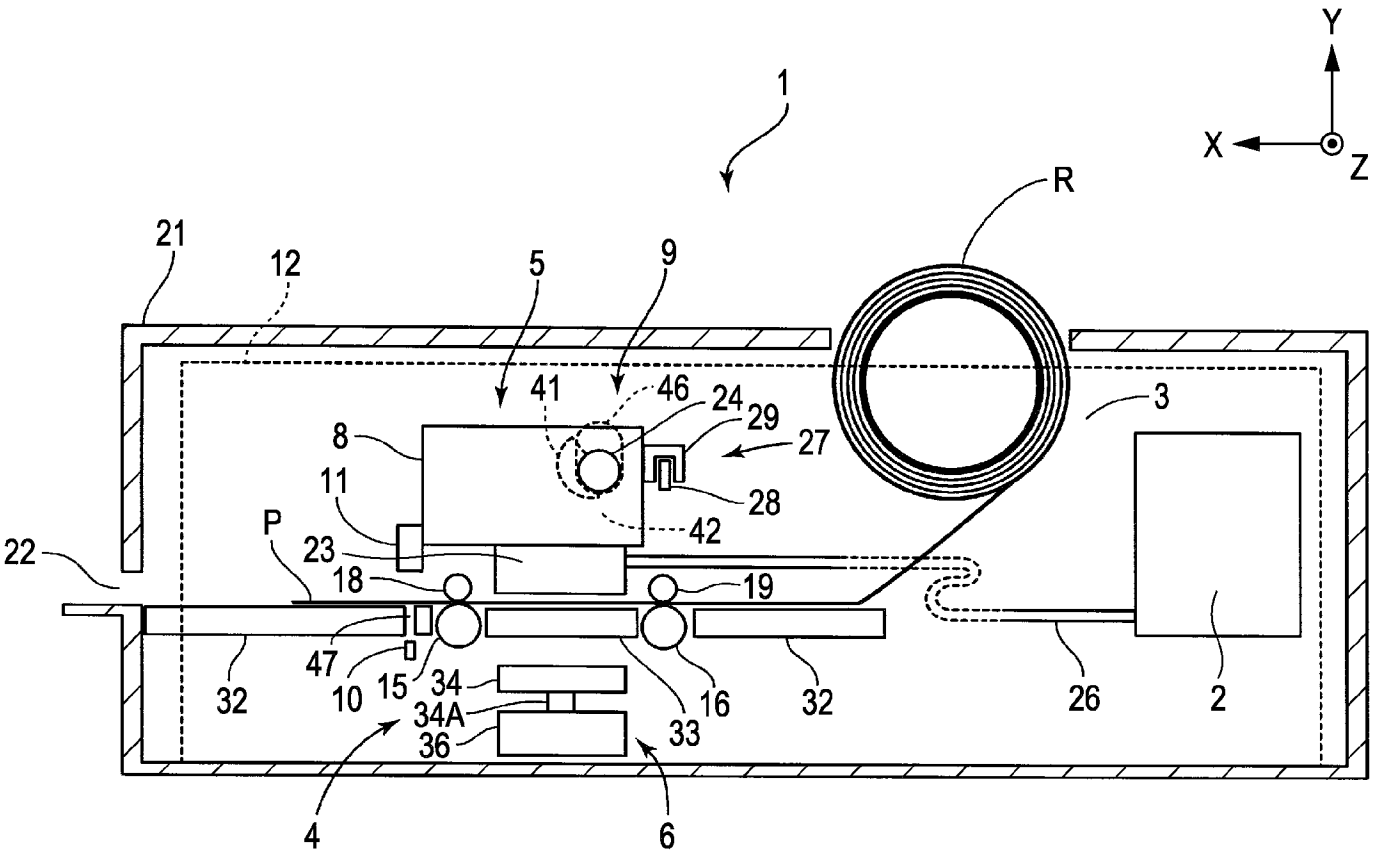
FIG. 1 is a diagram illustrating an overall schematic configuration of a printer according to an embodiment of the invention.
Figure 2:
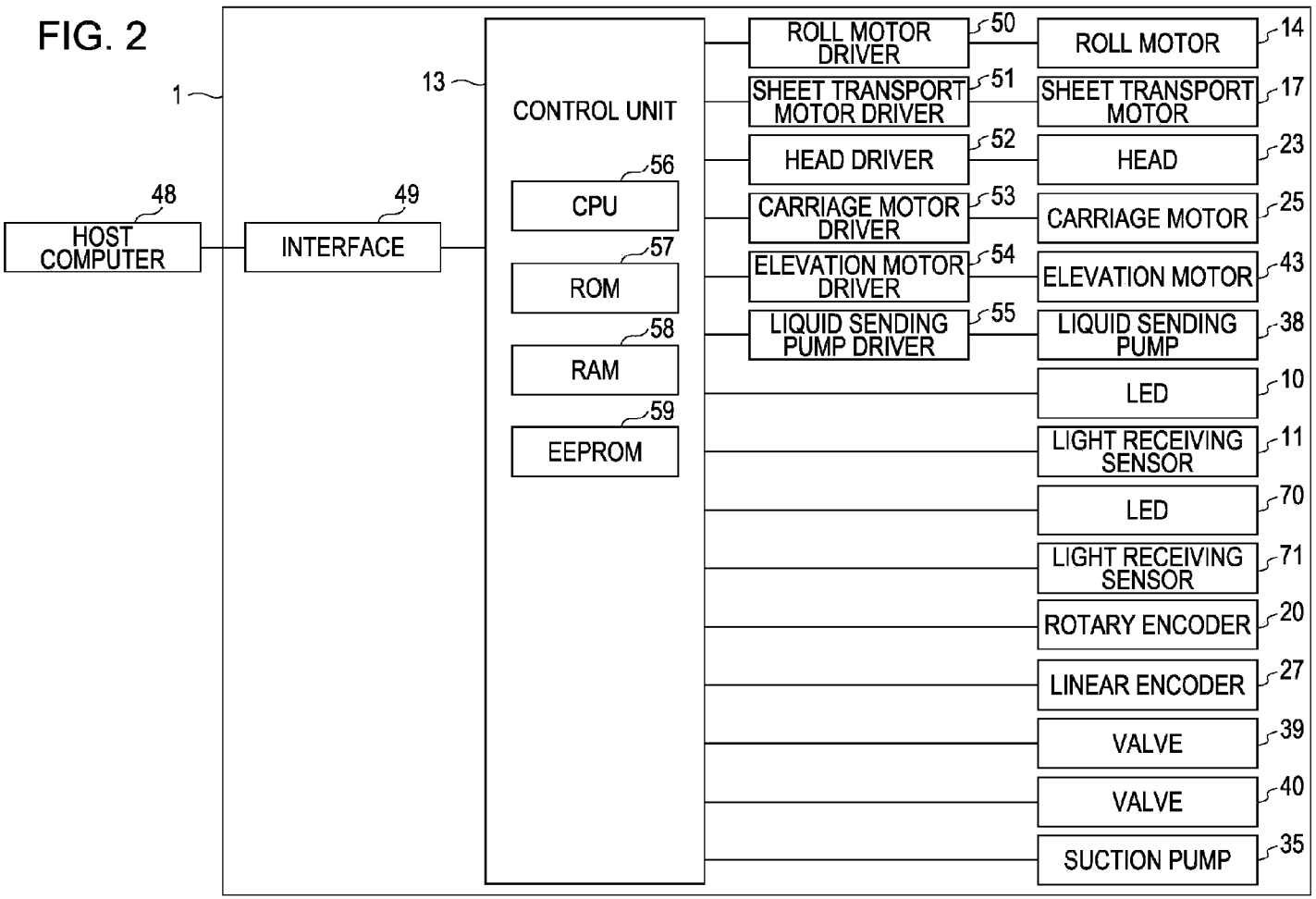
FIG. 2 is a circuit block diagram illustrating an electrical configuration of the printer shown in FIG. 1.

FIG. 1 is a diagram illustrating a schematic configuration of an ink jet printer (hereinafter, merely referred to as a printer) 1 as an example of a liquid ejecting apparatus according to an embodiment of the invention. FIG. 2 is a circuit block diagram illustrating a schematic electrical configuration of the printer 1 shown in FIG. 1. In the embodiment, the printer 1 sets a sheet roll R in which a band-shaped printing sheet P as a printing medium is wound. That is, the printer 1 is configured as a printer capable of printing (recording) characters and figures on the band-shaped printing sheet P drawn from the sheet roll R. In the following description, a direction of an arrow X shown in FIG. 1 is a front direction (a front side), a direction of arrow Y is an upper direction (an upside), a right-hand side from the front side to the rear side is a right direction (a right side), and a left-hand side is a left direction (a left side). FIG. 1 is a diagram as viewing the printer 1 from the right side.

The printer 1 includes an ink tank 2 that stores ink as a liquid, a sheet accommodating unit 3 that accommodates the sheet roll R in which the band-shaped printing sheet P is wound, a transport mechanism 4 that transports forward the printing sheet P drawn from the sheet roll R accommodated in the sheet accommodating unit 3, a printing mechanism 5 that ejects the ink stored in the ink tank 2 to the printing sheet P to print characters and figures, an ink suction mechanism 6, a stirring mechanism 7 (see FIG. 4), a paper gap adjusting mechanism 9 (see FIG. 3A and FIG. 3B) as a carriage moving unit that moves a carriage 8 in a direction of changing distance from the printing sheet P, an LED (Light Emitting Diode) 10, a first light emitting unit, a light receiving sensor 11 as a first light receiving unit, a frame 12 (see FIG. 3A and FIG. 3B), and a control unit 13 (see FIG. 2) that controls an operation of the printer 1 and is configured as a shielding degree determining unit. The frame 12 is disposed in an external case 21 of the printer 1, and the frame 12 is provided with the sheet accommodating unit 3, the transport mechanism 4, the printing mechanism 5, the ink suction mechanism 6, and the paper gap adjusting mechanism 9.

One or more ink tanks 2 may be provided, and at least one ink tank stores ink (hereinafter, referred to as sedimentation ink) as a liquid in which a contained component is sedimented with the lapse of time. That is, the printer 1 is configured as a printer capable of performing printing by the sediment. For example, the sedimentation ink may be a so-called pigment ink containing, as a contained component, a pigment having a specific weight greater than that of a solvent, or glossy ink containing, as a contained component, metal such as aluminum or fine powder of a purl pigment or a mica pigment to cause glossiness in a print portion. As the contained component of the sedimentation ink, for example, white sedimentation ink may be configured using midair resin particles of vinyl monomer such as styrene and vinyl toluene or using titanium dioxide or alumina.

The sheet accommodating unit 3 may be provided with a roll motor 14 (see FIG. 2), and the sheet roll R is rotated by the roll motor 14. The roll motor 14 is rotated in a direction (a forward rotation direction) of sending forward the printing sheet P wound on the sheet roll R.

The transport mechanism 4 is provided with a sheet transport roller 15 and a sheet transport roller 16 which are disposed back and forth to each other, and are rotated by a sheet transport motor 17 (see FIG. 2). Driven rollers 18 and 19 that are rotated by bringing the printing sheet P into press contact with the sheet transport rollers 15 and 16 are provided on the sheet transport roller 15 and the sheet transport roller 16.

The sheet transport motor 17 is provided with an optical rotary encoder 20 (see FIG. 2) that detects the rotation amount thereof. Accordingly, when the sheet transport motor 17 is rotated, an encoder signal that is a Hi-Low pulse signal is output according to the rotation thereof. It is possible to detect the rotation amount and the rotation rate of the sheet transport motor 17 on the basis of the encoder signal. That is, it is possible to detect the transport amount and the transport rate of the printing sheet P on the basis of the encoder signal output from the rotary encoder 20.

In a state where the printing sheet P is interposed between the sheet transport roller 15 and the driven roller 18 and between the sheet transport roller 16 and the driven roller 19, when the sheet transport roller 15 and the sheet transport roller 16 are rotated by the sheet transport motor 17 and the sheet roll R is rotated in the forward rotation direction by the roll motor 14, the printing sheet P is transported forward through the downside of the printing mechanism 5. The forward transported printing sheet P is discharged from a discharge port 22 formed in the external case 21 to the outside of the printer 1.

The printing mechanism 5 includes an ink ejecting head (hereinafter, merely referred to as a head) 23 as a liquid ejecting head, a carriage 8 on which the head 23 is mounted, a guide shaft 24 (hereinafter, merely referred to as a guide shaft) that guides movement of the carriage 8 in a main scanning direction (a left and right direction), a carriage motor 25 (see FIG. 2) that moves the carriage 8 in the main scanning direction through a timing belt (not shown), an ink tank 2 that stores the ink, and an ink supply tube 26 that constitutes an ink supply flow path for supplying the ink from the ink tank 2 to the head 23. When a plurality of ink tanks 2 are provided, the ink supply tube 26 may be provided for each ink tank 2, and ink ejection nozzles of the head 23 may be separately provided for each ink tank 2.

The carriage 8 is reciprocally moved in the main scanning direction along the guide shaft 24 by a driving force of the carriage motor 25, and the head 23 is also moved integrally with the carriage 8 in the main scanning direction. The head 23 is moved at a predetermined position of the printing sheet P by the movement of the head 23 in the main scanning direction and the movement of the printing sheet P from the front side to the rear side by the transport mechanism 4. The ink is ejected to the printing sheet P to perform printing.

The printing mechanism 5 is provided with an optical linear encoder 27 that detects a position and a movement rate of the carriage 8. The linear encoder 27 is provided with a linear scale 28 that is provided in parallel to the guide shaft 24, and an encoder sensor 29 that reads the linear scale 28. The encoder sensor 29 is mounted on the carriage 8, and is provided with an LED 30 and a light receiving sensor 31 disposed with the linear scale 28 interposed therebetween.

When the carriage motor 25 is driven and the carriage 8 is moved in the main scanning direction, the light emitted from the LED 30 to the light receiving sensor 31 is shielded and allowed to pass by the linear scale 28. Accordingly, an encoder signal that is a Hi-Low pulse signal corresponding to the shielding and passing of the emitted light is output from the light receiving sensor 31, and it is possible to detect the movement position and the movement rate of the carriage 8 on the basis of the encoder signal. By counting the number of pulses of the encoder signal from a predetermined reference position, it is possible to know the current position of the carriage 8 as a distance from the predetermined reference position.

A guide plate 32 that supports a lower face of the printing sheet P is provided from the sheet accommodating unit 3 to the discharge port 22. The printing sheet P drawn from the sheet accommodating unit 3 is sent from the front side to the rear side while being guided by an upper face of the guide plate 32, and is discharged from the discharge port 22. The guide plate 32 disposed between the sheet transport roller 15 and the sheet transport roller 16 serves as a so-called platen 33 supporting a range of the printing sheet P subjected to printing by the head 23 from the downside. A hole portion 47 that allows the light output from the LED 10 to pass through the upside of the guide plate 32 is formed on the front side of the sheet transport roller 16 of the guide plate 32. The printing sheet P transported on the guide plate 32 is transported on the hole portion 47.

The ink suction mechanism 6 includes a cap 34, a suction pump 35 (see FIG. 2), and a waste tank 36. In a state where the ink ejection nozzles of the head 23 are sealed by the cap 34, when the suction pump 35 is operated, the inside of the cap 34 is in a negative pressure state, and it is possible to discharge the ink in the nozzles of the head 23 and in the ink supply tube 26 to the cap 34 side. The waste ink discharged to the cap 34 is stored in the waste tank 36 through a waste pipe 34A. The ink suction mechanism 6 is disposed on the outside of the printing area on the left (or right) side of the printing area. Accordingly, in the discharge operation of the ink, the carriage 8 is moved such that the head 23 is disposed on the ink suction mechanism 6.

Figure 4:
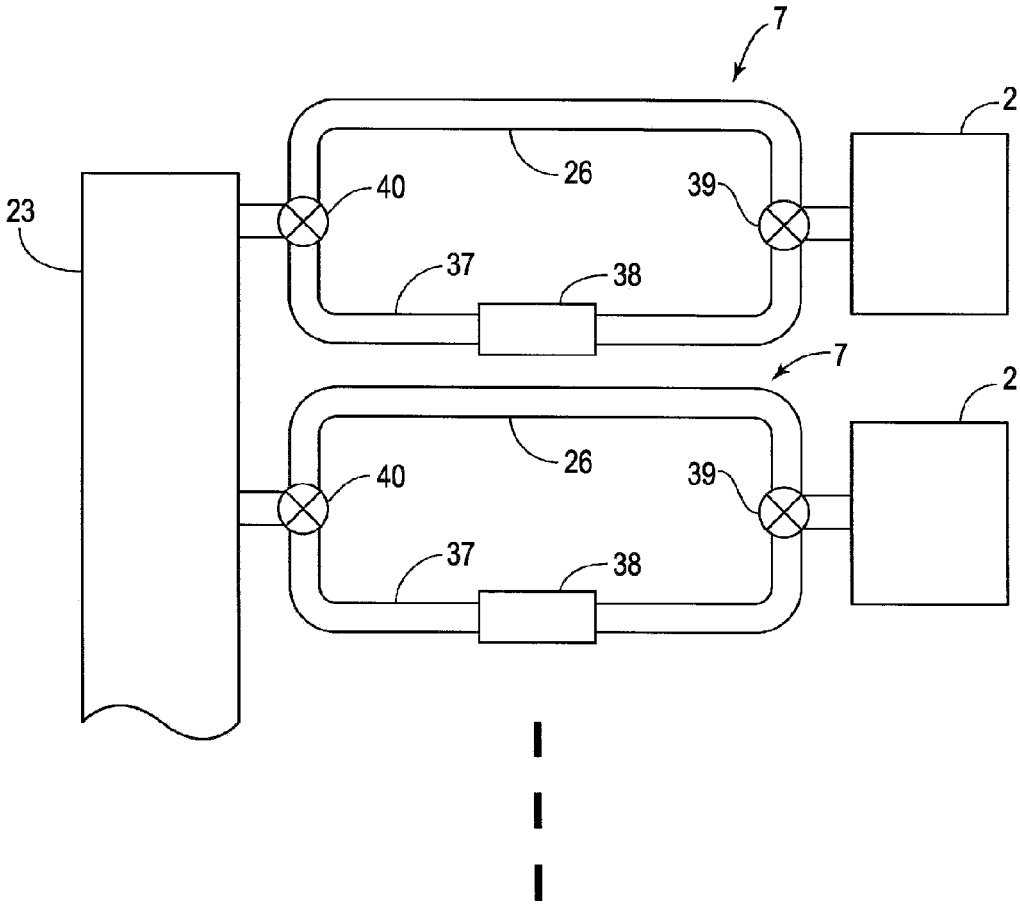
FIG. 4 is a diagram illustrating a configuration of a stirring mechanism provided in the printer shown in FIG. 1.

As shown in FIG. 4, the stirring mechanism 7 may be provided in the ink supply tube 26 of the ink tank 2 storing the sedimentation ink, and stirs the ink in the ink supply tube 26. The stirring mechanism 7 includes an ink reflux tube 37 that is connected to the ink supply tube 26, the upstream side (an end portion on the ink tank 2 side) and the downstream side (an end portion on the head 23 side) of the ink supply tube 26, and a liquid sending pump 38. Connection portions between the ink supply tube 26 and the ink reflux tube 37 are provided with valves 39 and 40, respectively. The valves 39 and 40 are configured as so-called electromagnetic valves capable of changing a position of a plate by an electromagnetic mechanism.

The valve 39 selectively changes the position of the plate to an ink supply position and a stirring position. The ink supply position is a position of communicating between the ink tank 2 and the ink supply unit 26 and blocking communication between the ink reflux tube 37 and the ink supply tube 26. The stirring position is a position of communicating between the ink supply tube 26 and the ink reflux tube 37.

The valve 40 selectively changes the position of the plate to the ink supply position and the stirring position. The ink supply position in the plate of the valve 40 is a position of communicating between the ink supply tube 26 and the head 23 and blocking communication between the ink reflux tube 37 and the ink supply tube 26. The stirring position is a position of communicating between the ink supply tube 26 and the ink reflux tube 37.

Accordingly, when the positions of the plates of the valves 39 and 40 are changed to the ink supply position, the ink tank 2 and the head 23 communicate with each other through the ink supply tube 26, and it is possible to supply the ink in the ink tank 2 to the head 23. Meanwhile, the positions of the plates of the valves 39 and 40 are changed to the stirring position, the ink supply tube 26 and the ink reflux tube 37 communicate with each other through the valves 39 and 40. Accordingly, when the liquid sending pump 38 is driven while the plates of the valves 39 and 40 are changed to the stirring position, it is possible to circulate the ink positioned in the ink supply tube 26 and the ink reflux tube 37, in the ink supply tube 26 and the ink reflux tube 37. The ink is stirred by the circulation in the ink supply tube 26 and the ink reflux tube 37.

Figure 3A:
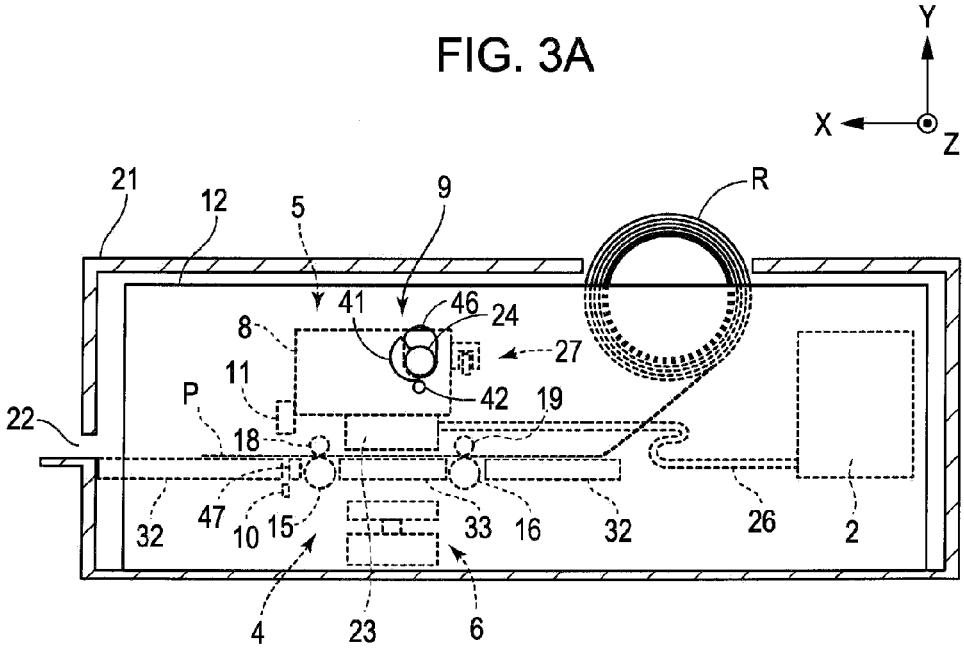
FIG. 3A and FIG. 3B are diagrams illustrating a configuration of a paper gap adjusting mechanism provided in the printer shown in FIG. 1.
Figure 3B:
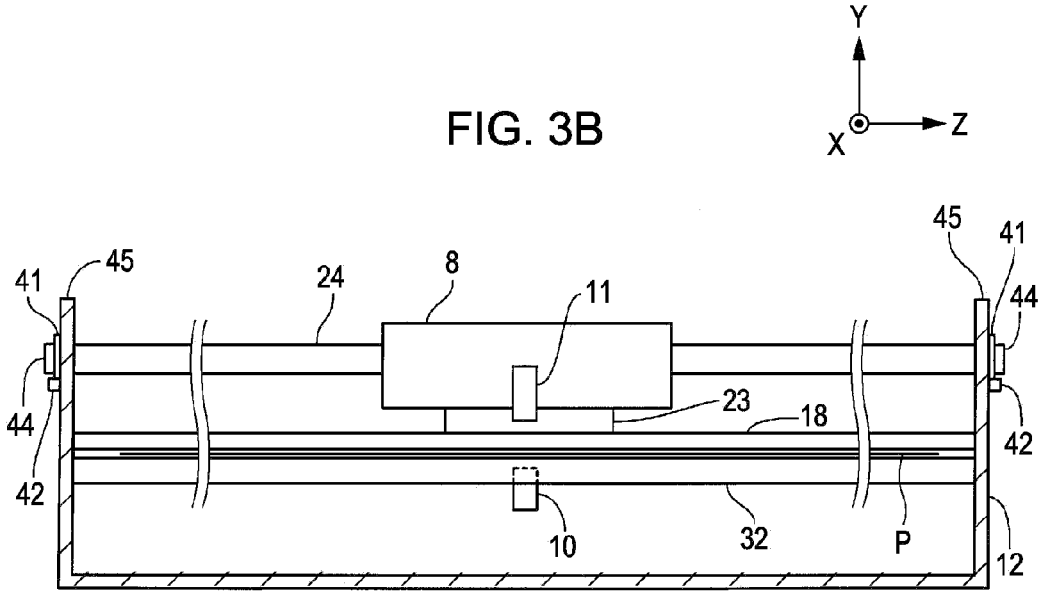

As shown in FIG. 3A and FIG. 3B, the paper gap adjusting mechanism 9 has cams 41, cam followers 42, and an elevation motor 43 (see FIG. 2). The cams 41 are disposed on the outside of left and right side walls 45 and 45 of the frame 12, with the cams 41 mounted on both ends 44 and 44 of the guide shaft 24. The cam followers 42 are provided at a position that is a lower portion of the guide shaft 24 of the outside of each side wall 45 to protrude outward. The guide shaft 24 is supported by the cam followers 42 through the cam 41. The guide shaft 24 is supported through the cams 41 by the cam followers 42. The side walls 45 and 45 are provided with longitudinal holes 46 longitudinal in the up and down direction, and both ends of the guide shaft 24 pass through the longitudinal holes 46. The longitudinal holes 46 allow movement of the guide shaft 24 in the up and down direction, and regulate the movement in the front and rear direction. The guide shaft 24 is connected to the elevation motor 43 through a gear row (not shown), and may rotate around the long shaft of the guide shaft 24 by the rotation of the elevation motor 43.

Accordingly, when the guide shaft 24 is rotated by the elevation motor 43, the guide shaft 24 is moved in the up and down direction by operations of the cams 41 and the cam followers 42. That is, the carriage 8 is moved in the up and down direction. By moving the carriage 8 in the up and down direction, it is possible to adjust a distance (a paper gap) between a nozzle formed face of the head 23 and the printing sheet P. Not in such a manner, but by a configuration of moving the guide plate 32 and the platen 33 in the up and down direction, the paper gap may be adjusted.

The LED 10 is disposed in the hole portion 47 formed on the guide plate 32 so that the transported printing sheet P does not protrude to the upside (the side to which the printing sheet P is transported) from the face (a platen surface) supported by the guide plate 32 (the plate 33). The Led 10 is disposed further forward than the head 23. For example, the LED 10 may be a white diode that outputs light throughout the almost whole area of a visible light area.

The light receiving sensor 11 is disposed on the more front side than the head 23 similarly to the LED 10. In the embodiment, the light receiving sensor 11 is provided on the front face side of the carriage 8. When the carriage 8 is moved up and down by the paper gap adjusting mechanism 9, the light receiving sensor 11 mounted on the carriage 8 is moved in the up and down direction integrally with the carriage 8. The light receiving sensor 11 includes a spectrum unit that is formed of a prism capable of dividing the incident light for each wavelength, and a photoelectric sensor such as a photo-transistor that receives the light in the spectrum wavelength area. That is, it is possible to obtain information of the light reception amount for each wavelength area in the light input to the light receiving sensor 11, from the light reception signal output from the light receiving sensor 11. The incident light may be divided using a filter instead of using the prism. For example, visible light beams of RGB (red, green, and blue) are allowed to pass through the filter, and the information of the light reception amount in each type of light may be obtained.

When the carriage 8 is disposed at a predetermined position, the LED 10 and the light receiving sensor 11 are disposed at positions opposed to each other. By disposing the LED 10 and the light receiving sensor 11 as described above, it is possible to measure a shielding degree of a patch T1 (see FIG. 5) portion (a part where a patch T1 of the printing sheet P is printed) printed on the printing sheet P using the LED 10 and the light receiving sensor 11 to be described later. The patch T1 is printed on the printing sheet P, and the movement of the carriage 8 and the transport of the printing sheet P are performed such that the patch T1 portion is disposed between the LED 10 and the light receiving sensor 11. The light output from the LED 10 is allowed to pass through the patch T1 portion, the passing light is received by the light receiving sensor 11, and the shielding degree of the patch T1 portion is measured on the basis of the light reception signal of the light receiving sensor 11. The printer 1 determines whether or not the sedimentation state occurs in the ink in the ink supply tube 26 on the basis of the shielding degree. The sedimentation state means a state where the contained component contained in the ink is sedimented and the concentration of the contained component of the ink is different between the upper layer side and the lower layer side. When the printer 1 determines that the sedimentation state occurs in the ink, the printer 1 performs driving of the stirring mechanism (see FIG. 4) to stir the ink in the ink supply tube 26.

Electrical Configuration of Printer 1

Next, a schematic configuration of a part relating to an electrical control of the printer 1 shown in FIG. 1 will be described with reference to FIG. 2.

The printer 1 includes an interface 49 that receives image forming data output from a host computer 48, a control unit 13, a roll motor 14, a roll motor driver 50 that drives the roll motor 14, a sheet transport motor 17, a sheet transport motor driver 51 that drives the sheet transport motor 17, a head 23, a head driver 52 that drives and control the head 23, a carriage motor 25, a carriage motor driver 53 that drives the carriage motor 25, an elevation motor 43, and an elevation motor driver 54 that drives the elevation motor 43, a liquid sending pump 38, a liquid sending pump driver 55 that drives the liquid sending pump 38, an LED 10, a light receiving sensor 11, a rotary encoder 20, a linear encoder 27, and valves 39 and 40.

The control unit 13 includes a CPU (Central Processing Unit) 56 that controls various operations of the printer 1, a ROM (Read-Only Memory) 57 in which process programs relating to various operations of the printer 1 are stored, a RAM (Random Access Memory) 58 that stores the image forming data input from the host computer 48 through the interface 49 and serves as a work memory, and an EEPROM (Electrically Erasable Programmable Read-Only Memory) 59 that stores information about the printer 1. As for the control unit 13 or the CPU 56, the host computer 48 may be used.

Printing Operation of Printer 1

A printing operation, an operation of measuring a shielding degree, and a sedimentation dissolution operation of the printer 1 having the configuration described above will be described. The printing operation, the operation of measuring the shielding degree, and the sedimentation dissolution operation of the printer 1 are performed according to the program stored in advance in the ROM 57 by the control unit 13.

Printing Operation

In the state where the printing sheet P is set, when a printing start button (not shown) is pressed, the roll motor 14, the sheet transport motor 17, the head 23, and the carriage motor 25 are controlled to be driven by the control unit 13, and the printing operation is performed on the printing sheet P on the basis of the image forming data output from the host computer 48.

In the printer 1, before the printing operation, a distance between the nozzle formed face of the printing head 23 and the printing sheet P, that is, a so-called paper gap is adjusted such that a flying distance of ink droplets flying from the head 23 toward the printing sheet P is a regulated distance irrespective of a thickness of the printing sheet P. For example, the adjustment of the paper gap may be performed as follows. The sheet thickness of the printing sheet P is stored in advance for each kind of the printing sheet P, in the ROM 57. The elevation motor 43 is driven on the basis of the sheet thickness corresponding the kind of the printing sheet P input from the input unit such as the touch panel (not shown) of the printer 1, and the carriage 8 is elevated to a predetermined position corresponding to the sheet thickness of the printing sheet P.

When the adjustment of the paper gap is completed, the roll motor 14 and the sheet transport motor 17 are driven by the control unit 13, and the printing sheet P is transported in the front direction (a sub-scanning direction). Meanwhile, the head 23 is reciprocally moved in the left and right direction (the main scanning direction) by the driving of the carriage motor 25. The transport of the printing sheet P and the reciprocal movement of the head 23 are alternately and intermittently performed, the head 23 is driven on the basis of the image forming data, and the ink is ejected at a predetermined timing, thereby forming an image on the printing sheet P.

Operation of Measuring Shielding Degree and Sedimentation Dissolution Operation

Figure 5:
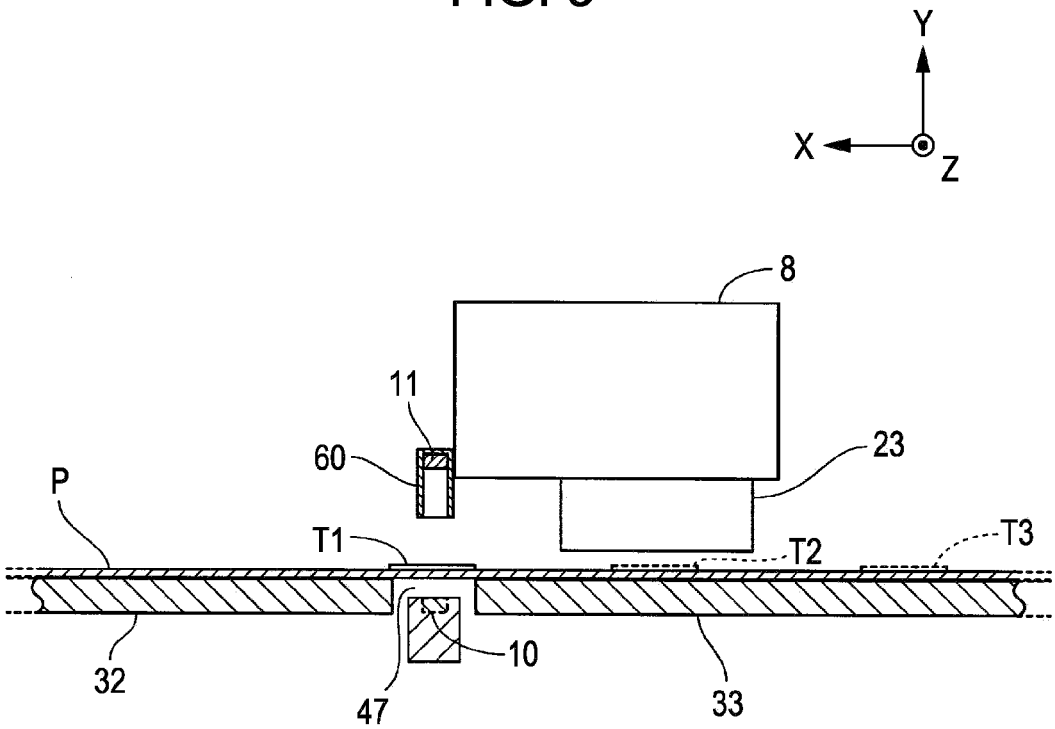
FIG. 5 is a diagram illustrating a measurement operation of a shielding degree of a patch-printed portion.

Next, an operation of measuring a shielding degree and a sedimentation dissolution operation among the operations of the printer 1 will be described with reference to FIG. 5 and the flowchart shown in and FIG. 6.

The operation of measuring the shielding degree is performed, mainly when printing is performed by the sedimentation ink. In the printer 1, when a period in which the printing operation using the sedimentation ink is not performed is long, there is high possibility that the sedimentation state occurs in the sedimentation ink remaining in the ink supply tube 26 or in the ink tank 2. When printing is performed using ink in which the sedimentation state occurs, it may be difficult to obtain printing quality with a predetermined shielding degree. When printing is not performed with the predetermined shielding degree, for example, there is a problem that a background color of the printing sheet P is faintly viewed from the printing unit. When the printing sheet P is formed of a transparent material, there is a problem that the other side of the printing sheet P is faintly viewed from the printing unit.

When the printing is performed by the sedimentation ink, before the printing operation, as will be described later, a patch as a measurement target portion is printed by the sedimentation ink, and a shielding degree of the patch-printed portion is measured. It is determined whether or not the sedimentation state occurs in the sedimentation ink on the basis of the measurement result. When it is determined that sedimentation state occurs, an operation of dissolving the sedimentation is performed.

In the measurement of the shielding degree, first, the patch T1 (see FIG. 5) is printed on the printing sheet P by the sedimentation ink (Step S10). The printing (Step S10) of the patch T1 may be performed by performing the printing operation described above by the printer 1. In the ejection start early stage of the ink, the ink in the head 23 is ejected, and then the ink in the ink supply tube 26 is ejected. As will be described later, it is determined whether or not the sedimentation state occurs in the sedimentation ink remaining in the ink supply tube 26 by the shielding degree of the patch T1 portion. For this reason, it is necessary to perform the printing of the patch T1 such that the patch T1 is formed by the ink in the ink supply tube 26. Accordingly, a size of the printed patch T1 is a size in which at least a part of the patch T1 is formed by the ink in the ink supply tube 26. Accordingly, at the time of printing the patch T1, the positions of the plates of the valves 39 and 40 are changed to the ink supply position.

Then, the control unit 13 moves the carriage 8 and transports the printing sheet P such that the part of the patch T1 printed by the ink in the ink supply tube 26 is disposed on the optical path of the light emitted from the LED 10 toward the light receiving sensor 11 (Step S20). The light is output from the LED 10, the light passing through the printing sheet P and the patch T1 is received by the light receiving sensor 11, and the shielding degree of the patch T1 is measured on the basis of the light reception signal output from the light receiving sensor 11 (Step S30). The control unit 13 configured as the shielding degree determining unit acquires the shielding degree on the basis of the light quantity for each wavelength area of the light output from the LED 10 and the light quantity for each wavelength received by the light receiving sensor 11, and determines whether or not the patch T1 portion has a predetermined shielding degree. The light quantity for each wavelength of the light output from the LED 10 is a predetermined value, and the light quantity of the light for each wavelength received by the light receiving sensor 11 may be acquired from the light reception signal output from the light receiving sensor 11.

The shielding degree denotes an integral value of the transmittance in a predetermined wavelength area. In the embodiment, in a wavelength area from 380 nm to 700 nm as a visible light area, an integral value of transmittance for each wavelength with the interval of 1 nm is referred to as a shielding degree. That is, the shielding degree in the range of 380 nm to 700 nm is a value of 0 to 32000. Accordingly, at a part where the patch T1 is printed, a shielding degree when the light in the wavelength area from 380 nm to 700 nm is completely blocked is "0". On the other hand, a shielding degree when all of the (100%) light is allowed to pass is "32000". When the light output from the LED 10 is divided into visible light of RGB (red, green, and blue) using a filter and the light receiving sensor 11 is configured to obtain the light reception amount for each color light, an integral value of transmittance for each color light is a shielding degree.

When the sedimentation state occurs in the sedimentation ink in the ink supply tube 26, the shielding degree is high or low as compared with a case where the sedimentation state does not occur. That is, when the ink of a low concentration part of the contained component of the upper layer of the ink in the sedimentation state is ejected, the shielding degree is low. When the ink of a high concentration part of the contained component of the lower layer is ejected, the shielding degree is high. Accordingly, the shielding degree when the patch T1 is printed with the sedimentation ink in which the sedimentation state does not occur is set to a predetermined value, and is stored in advance in the ROM 57. By comparing the shielding degree measured by the predetermined shielding degree, it is possible to determine whether or not the sedimentation state occurs in the sedimentation ink.

The shielding degree of the patch T1 portion printed by the sedimentation ink in which the sedimentation state does not occur is, for example, equal to or more than 15000 and equal to or less than 25000. When the measured shielding degree is lower or higher than this range, the stirring operation is performed. When the measured shielding degree is less than 15000, it may be presumed that the contained component of the sedimentation ink is sedimented and the ink of the low concentration part of the contained component of the upper layer is ejected from the head 23. When the measure shielding degree is more than 25000, it may be presumed that the contained component of the sedimentation ink is sedimented and the ink of the high concentration part of the contained component of the lower layer is ejected from the head 23. The wavelength area of measuring the shielding degree, the distance of the wavelength area of measuring the transmittance, and the predetermined range described above are examples for description, and practically, are appropriately determined by a color and a light shielding property of the printing sheet P, an application of prints, a contained component, and the like.

When the shielding degree is measured (Step S30) and the measured shielding degree is lower or higher than a predetermined value, that is, when the shielding degree is not normal (Step S40: No), a stirring operation of stirring the sedimentation ink in the ink supply tube 26 is performed (Step S50). In the stirring operation (Step S50), the positions of the plates of the valves 39 and 40 are changed to the stirring position, and the liquid sending pump 38 is driven. When the liquid sending pump 38 is driven, the sedimentation ink is circulated between the ink supply tube 26 and the ink reflux tube 37, and it is possible to stir the sedimentation ink in the ink supply tube 26. Accordingly, it is possible to dissolve the contained component of the sedimentation ink in the ink supply tube 26. The stirring operation (Step S50) is performed, for example, while the ink is circulated ten times between the ink supply tube 26 and the ink reflux tube 37.

When the measured shielding degree is not normal (Step S40: No), the sedimentation state of the sedimentation ink in the ink supply tube 26 may be reported to a user by a report unit that displays a message or generates an alarm sound, instead of performing the stirring operation (Step S50). By the report, the user may take measures such as instructing the printer 1 to perform the stirring operation of the ink.

After the stirring operation (Step S50) is completed, a patch T2 is printed by the same ink as the sedimentation ink by which the patch T1 is printed (Step S60), the movement of the carriage 8 and the transport of the printing sheet P are performed (Step S70), and the shielding degree of the patch T2 portion (a part the printing sheet P where the patch T2 is printed) is measured (Step S80). The printing of the patch T2 (Step S60), the movement of the carriage 8 and the transport of the printing sheet P (Step S70), and the measurement of the shielding degree of the patch T2 portion (Step S80) are the same operations as the previous printing of the patch T1 (Step S10), the movement of the carriage 8 and the transport of the printing sheet P (Step S20), and the measurement of the shielding degree of the patch T1 portion (Step S30). The printing of the patch T2 (Step S60) is performed at a position different from that of the previous patch T1. In the printing of the patch T2 (Step S60), each position of the plates of the valves 39 and 40 are changed to the ink supply position.

After the stirring operation (Step S50) is completed, the printing of the patch T2 (Step S60) and the measuring of the shielding degree of the patch T2 portion (Step S80) are performed, and thus it is possible to determine whether or not the sedimentation state of the ink in the ink supply tube 26 has been dissolved as a result of the stirring operation (Step S50). When the measured shielding degree is lower or higher than a predetermined value, that is, when the shielding degree is not normal (Step S90: No), the possibility that the sedimentation state of the ink in the ink supply tube 26 has not been dissolved as a result of the performing of the stirring operation (Step 50) is high.

In this case (Step S90: No), a suction operation is performed (Step S100). The head 23 is moved out of the printing area where the ink suction mechanism 6 is disposed, and the suction operation is performed. The head 23 is sealed by the cap 34, the suction pump 35 is driven, and the ink in the nozzles and the ink supply tube 26 is discharged to the inside of the cap 34. Accordingly, the ink in the sedimentation state in the ink supply tube 26 is discharged, and it is possible to supply the ink in the ink tank 2 to the ink supply tube 26. In the dissolution of the sedimentation state, the stirring operation is performed before the suction operation of discharging the ink as waste ink is performed, and thus it is possible to suppress consumption of the ink as compared with the case of performing the dissolution of the sedimentation state only by the suction of the sedimentation ink.

When the measured shielding degree is not normal (Step S90: No), the sedimentation state of the sedimentation ink in the ink supply tube 26 may be reported to a user by a report unit that displays a message or generates an alarm sound, instead of performing the suction operation (Step S100). By the reporting, the user may take measures such as instructing the printer 1 to perform the suction operation of the ink.

After the suction operation (Step S100) is completed, a patch T2 is further printed by the same ink as the sedimentation ink by which the patches T1 and T2 are printed (Step S110), the movement of the carriage 8 and the transport of the printing sheet P are performed (Step S120), and the shielding degree of the patch T3 portion (a part the printing sheet P where the patch T3 is printed) is measured (Step S130). The printing of the patch T3 (Step S110), the movement of the carriage 8 and the transport of the printing sheet P (Step S120), and the measurement of the shielding degree of the patch T3 portion (Step S130) are the same operations as the printing of the patch T1 (Step S10), the movement of the carriage 8 and the transport of the printing sheet P (Step S20), and the measurement of the shielding degree of the patch T1 portion (Step S30). The printing of the patch T3 (Step S110) is performed at a position different from those of the previous patches T1 and T2. In the printing of the patch T3 (Step S110), each position of the plates of the valves 39 and 40 are changed to the ink supply position.

After the suction operation (Step S100) is completed, the printing of the patch T3 (Step S110) and the measuring of the shielding degree of the patch T3 portion (Step S130) are performed, and thus it is possible to determine whether or not the sedimentation state of the ink in the ink supply tube 26 is dissolved by the suction operation (Step S100). When the measured shielding degree is lower or higher than a predetermined value, that is, when the shielding degree is not normal (Step S140: No), possibility that the sedimentation state of the ink in the ink supply tube 26 is not dissolved is high according to the performing of the suction operation, in addition to the non-dissolution of the sedimentation state of the ink in the ink tank 2 (Step 100). In this case (Step S140: No), reporting is performed to a display unit or a sound generating mechanism (not shown) provided in the printer 1, by display or sound generation of possibility that the sedimentation occurs in the sedimentation ink in the ink tank 2 (Step S150). By the reporting of the reporting unit, it is possible to prompt the user to take measures to dissolve the sedimentation of the ink in the ink tank 2. For example, the user who sees this display detaches the ink tank 2 from the printer 1, shakes the detached ink tank 2, or exchanges the ink tank 2 for new one.

In the determining of the shielding degree (Step S40, Step S90, and Step S140) described above, when it is determined that the shielding degree is a value in a predetermined range, that is, when it is determined that the shielding degree is normal, it is considered that the ink in the ink supply tube 26 is not in the sedimentation state or the sedimentation state is dissolved, the operation of measuring the shielding degree and the sedimentation dissolution operation are completed, and the process is transferred to the normal printing operation.

However, when the light (ambient light) other than the light output from the LED 10 is input to the light receiving sensor 11, the light is a noise, and precision in measurement may be decreased. For this reason, as shown in FIG. 5, a light shielding unit 60 is provided around the light receiving sensor 11 so as not to input the ambient light to the light receiving sensor 11. The light shielding unit 60 is cylindrical, the light receiving sensor 11 is disposed in an inner circumference of the cylinder, and the ambient light is not easily input to the light receiving sensor 11. FIG. 5 shows a schematic configuration of a cross section with respect to members excluding the carriage 8 and the head 23.

The printer 1 is provided with the paper gap adjusting mechanism 9. Accordingly, when the shielding degree is measured, the paper gap adjusting mechanism 9 is driven to change the position of the carriage 8 to the printing sheet P side, and it is possible to shorten the distance between the light receiving sensor 11 and the LED 10. By shortening the distance between the light receiving sensor 11 and the LED 10, the ambient light is not further easily input to the light receiving sensor 11. When the position of the carriage 8 is changed to the printing sheet P side at the time of measuring the shielding degree, the position of the nozzle formed face of the head 23 is changed such that the nozzle formed face does not come in contact with the printing sheet P.

Figure 7:
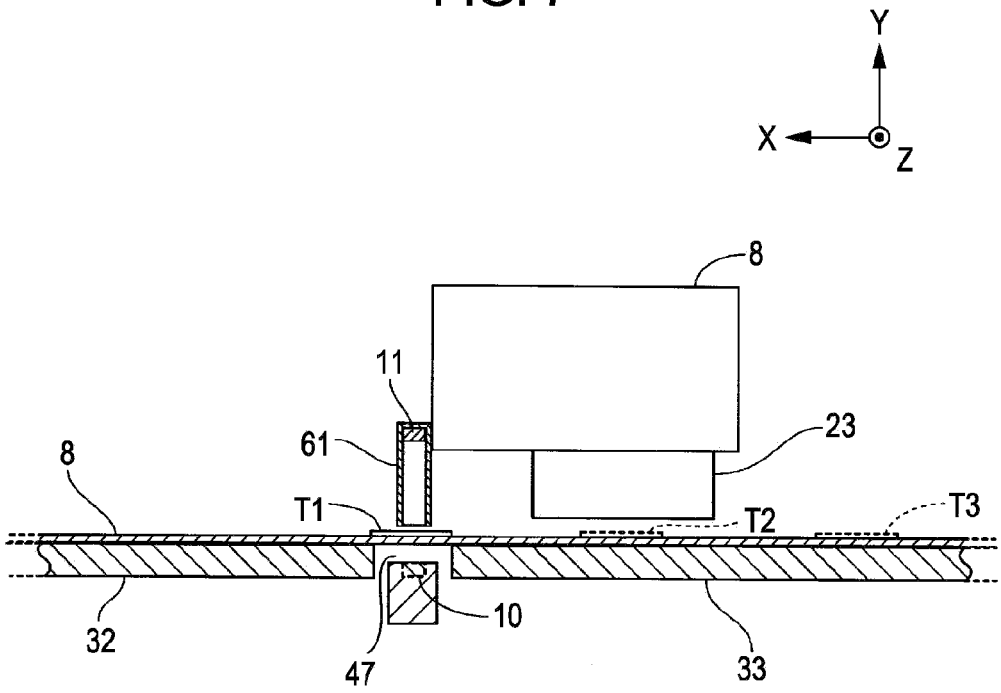
FIG. 7 is a diagram illustrating another configuration of a light shielding unit provided so as not to input ambient light to a light receiving sensor.

The light shielding unit 60 may have the same configuration as that of the light shielding unit 61 shown in FIG. 7. The light shielding unit 61 is cylindrical like the light shielding unit 60, and the light receiving sensor 11 is disposed in the inner circumference thereof. The end portion 61A of the light shielding unit 61 close to the printing sheet P protrudes to the printing sheet P side from the face of the carriage 8 on the printing sheet P side. The protrusion amount of the end portion 61A to the printing sheet P is set to approach the printing sheet P so as not to come in contact with the printing sheet P and the printing portion such as the patch in a state where the paper gap is adjusted in the printing operation. As described above, the end portion 61A approaches the printing sheet P, it is possible to reduce the ambient light entering from the portion between the printing sheet P and the end portion 61A to the light receiving sensor 11, and thus it is possible to improve the precision in measurement of the shielding degree.

Main Effect of Embodiment

As described above, the printer 1 as the ink ejecting apparatus capable of ejecting the sedimentation ink includes the LED 10 as the first light emitting unit that emits the light to the patch T1 (T2 and T3) portion as the measurement target portion printed on the printing sheet P as the printing medium by the sedimentation ink, the light receiving sensor 11 as the first light receiving unit that receives the light emitted from the LED 10 and passing through the patch T1 (T2 and T3) portion, and the control unit 13 as the shielding degree determining unit that determines whether or not the patch T1 (T2 and T3) portion has a predetermined shielding degree on the basis of the light reception signal output from the light receiving sensor 11.

The printer 1 configured as described above determines whether or not the printed patch T1 (T2 and T3) portion has the predetermined shielding degree. For this reason, when the patch portion does not have the predetermined shielding degree, the stirring operation for dissolving the sedimentation state of the sedimentation ink is performed or a predetermined operation such as reporting the occurrence of the sedimentation state in the ink to the user is performed.

As a type of printing, for example, the printing is performed on a transparent printing medium such as glass, PET (Polyethylene terephthalate), and polyvinyl chloride on the basis of the sedimentation ink, and characters and figures may be printed to overlap with the basis by color ink different from the ink color of the basis. In this case, when the sedimentation state occurs in the sedimentation ink used in the basis, printing quality may be decreased, for example, the original shielding degree is not obtained in the basis printing, the amount of light passing through the basis is increased or a plaque occurs in the shielding degree of the basis printing, and the characters and figures printed to overlap with the basis are not shine.

However, as described above, by measuring the shielding degree of the printed patch T1 (T2 and T3) portion, it is possible to know whether or not the sedimentation state occurs in the ink used in the printing from the measurement result. For this reason, when the basis printing is performed on the transparent printing medium using the sedimentation ink, it is possible to perform the basis printing by the ink without the sedimentation state.

In the printer 1, the LED 10 is disposed closer than the side separated from the printing sheet P than the surface of the platen 33.

The printer 1 is configured as described, and thus it is possible to prevent the printing sheet P transported on the plate 33 from coming in contact with the LED 10. The printing sheet P does not come in contact with the LED 10, and thus it is possible to prevent the LED 10 and the printing sheet P from being damaged.

The printer 1 includes the paper gap adjusting mechanism 9 as the carriage moving unit that moves the carriage 8 on which the head 23 is mounted in the direction of changing the distance from the printing sheet P, and the light shielding unit 60 that reduces the incidence of the light other than the light output from the LED 10, to the light receiving sensor 11, and the light receiving sensor 11 is mounted on the carriage 8.

As described above, the light receiving sensor 11 is provided with the light shielding unit 60, it is possible to prevent light (ambient light) other than the light output from the LED 10 from being input to the light receiving sensor 11, and it is possible to improve the precision in measurement of the shielding degree. The paper gap adjusting mechanism 9 is provided, the carriage 8 is provided with the light receiving sensor 11, it is possible to shorten the distance between the light receiving sensor 11 and the LED 10, and thus it is more difficult to input the ambient light to the light receiving sensor 11.

The printer 1 has the stirring mechanism 7 as the sedimentation dissolution unit that dissolve the sedimentation state of the sedimentation ink on the flow path from the ink tank 2 storing the sedimentation ink to the nozzles of the head 23. When the control unit 13 determines that the patch T1 portion does not have a predetermined shielding degree, the stirring mechanism 7 is driven.

The printer 1 is configured as described above, and it is possible to dissolve the sedimentation state when the sedimentation state occurs in the sedimentation ink. The printer 1 is provided with the ink suction mechanism 6 as the suction mechanism as the sedimentation dissolution unit, in addition to the stirring mechanism 7. The ink suction mechanism 6 is provided. When the sedimentation state of the ink is not dissolved even when the stirring is performed by the stirring mechanism 7, the suction is performed by the ink suction mechanism 6, and thus it is possible to more reliably dissolve the sedimentation state.

As described above, the method of controlling the printer 1 includes the measurement target portion printing step (Step S10, S60, and S110) of ejecting the sedimentation ink to the printing sheet P to form the patch T1 (T2 and T3), the shielding degree measuring step (Step S30, S80, and S130) of emitting the light to the patch T1 (T2 and T3) portion by the LED 10, and measuring the shielding degree of the patch T1 (T2 and T3) portion on the basis of the emitted light passing through the patch T1 portion, the shielding degree determining step (Step S40, S90, and S140) of determining whether or not the patch portion has a predetermined shielding degree, and the sedimentation dissolution step (Step S50, S100, and S150) of dissolving the sedimentation state of the ink in the ink supply tube 26 that is the ink flow path (liquid flow path) from the ink tank 2 storing the ink to the head 23, when it is determined that the patch portion does not have the predetermined shielding degree (an abnormal shielding degree) in the shielding degree determining step. A control plug RAM for causing the printer 1 to execute the control method is stored in the ROM 57.

By controlling the printer 1 as described above, it is possible to determine whether or not the printed patch T1 portion has the predetermined shielding degree. For this reason, when the patch portion does not have the predetermined shielding degree, the stirring operation for dissolving the sedimentation state of the sedimentation ink may be performed or a predetermined operation such as reporting the occurrence of the sedimentation in the ink to the user may be performed.

Second Embodiment

Figure 8:
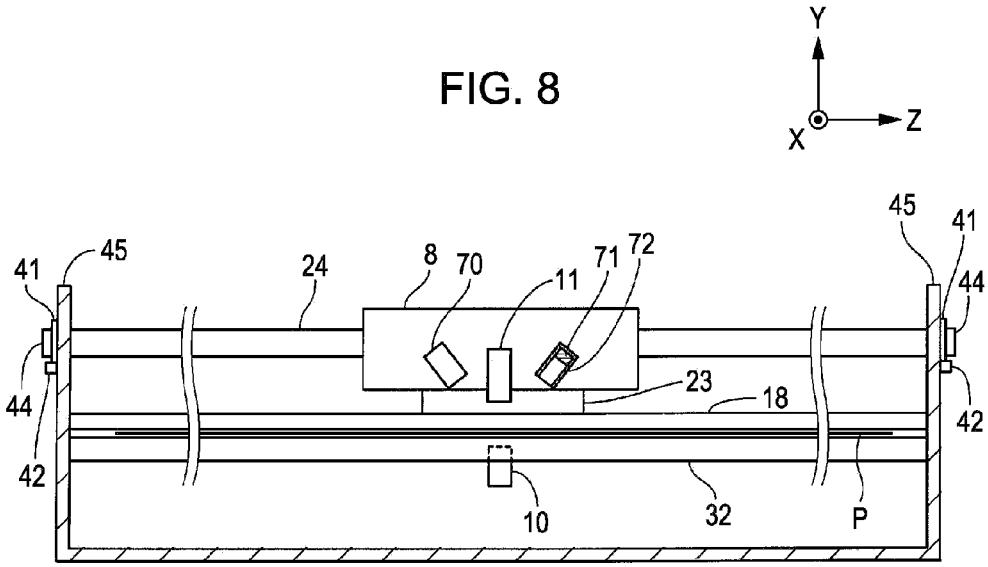
FIG. 8 is a diagram illustrating a printer according to another embodiment.

As shown in FIG. 2 and FIG. 8, the printer 1 may include an LED 70 as a second light emitting unit, and a light receiving sensor 71 as a second light receiving unit, in addition to the LED 10 and the light receiving sensor 11. Both the LED 70 and the light receiving sensor 71 are disposed on the printing face side of the printing sheet P. The LED 70 is disposed to emit light to the patch T1, and the light receiving sensor 71 is disposed to receive the light reflected from the patch T1 and output from the LED 70. The LED 70 and the light receiving sensor 71 are disposed on the front side of the head 23 and are mounted on the front face side of the carriage 8, similarly to the LED 10 and the light receiving sensor 11. The LED 70 and the light receiving sensor 71 are disposed with the light receiving sensor 11 interposed therebetween.

As the LED 70, a white diode capable of emitting the light throughout the whole area of the visible light area is used, similarly to the LED 10. Similarly to the light receiving sensor 11, the light receiving sensor 71 includes a spectrum unit capable of dividing the incident light for each wavelength, and a photoelectric sensor such as photo-transistor that receives the light in the spectrum wavelength area. It is possible to obtain information of the light reception amount for each wavelength area in the light input to the light receiving sensor 71, from the light reception signal output from the light receiving sensor 71. Accordingly, it is possible to measure a gloss degree of the patch T1 (see FIG. 9) printed on the printing sheet P using the LED 70 and the light receiving sensor 71. The printer 1 determines whether or not the sedimentation state occurs in the ink in the ink supply tube 26 on the basis of the measured gloss degree. When the printer 1 determines that the sedimentation state occurs in the ink, the printer 1 drives the stirring mechanism (see FIG. 4) to perform stirring of the ink in the ink supply tube 26. The light receiving sensor 71 may divide the light input using a filter. For example, visible light beams of RGB (red, green, and blue) are allowed to pass through the filter, and the information of the light reception amount in each light may be obtained.

The light receiving sensor 11 and the light receiving sensor 71 may be the same sensor. For example, the light receiving sensor 11 may be provided with the function of the light receiving sensor 71, or the light receiving sensor 71 may be provided with the function of the light receiving sensor 11.

Operation of Measuring Gloss Degree and Sedimentation Dissolution Operation

Figure 9:
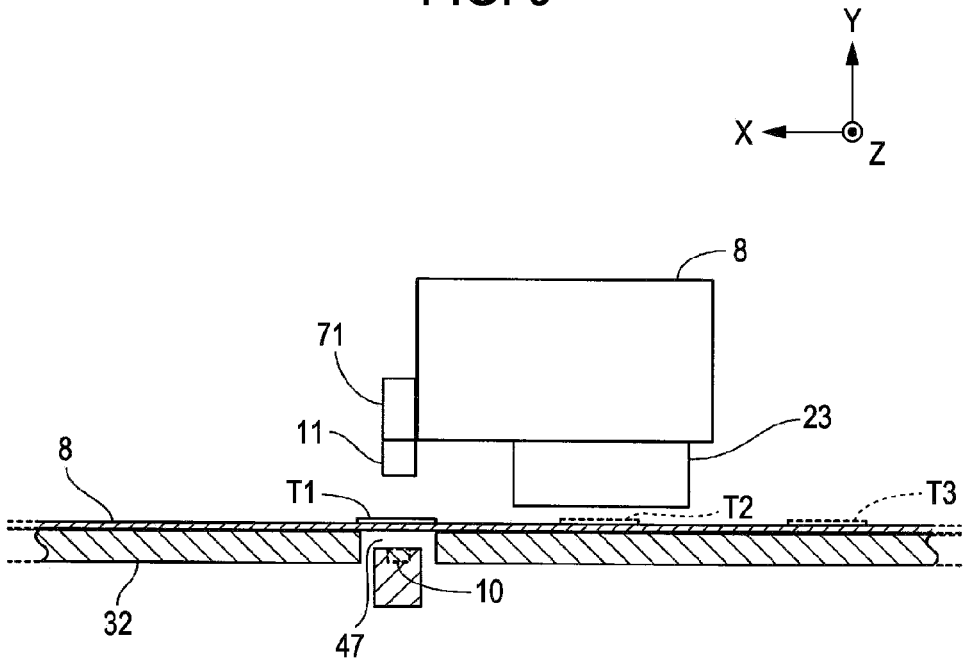
FIG. 9 is a diagram illustrating a gloss degree measuring operation of the patch-printed portion.

Next, among the operations of the printer 1, the operation of measuring the gloss degree and the sedimentation dissolution operation will be described with reference to FIG. 9 and the flowchart shown in FIG. 10. The operation of measuring the gloss degree and the sedimentation dissolution operation of the printer 1 are performed according to a program stored in advance in the ROM 57 by the control unit 13. FIG. 9 shows a schematic configuration of a cross section with respect to members excluding the carriage 8, the head 23, the light receiving sensor 11, and the light receiving sensor 71.

The operation of measuring the gloss degree is performed mainly when printing is performed by glossy ink. When the glossy ink is used as the ink of the printer 1 and when a period in which the printing operation using the glossy ink is not performed is long, possibility that the contained component of the glossy ink remaining in the ink supply tube 26 is sedimented is high. When the printing is performed in the state where the sedimentation occurs in the glossy ink, it is difficult to obtain printing quality with predetermined gloss. When the printing is performed by the glossy ink, before the printing operation, as described above, the patch as the measurement target is printed by the glossy ink, and the gloss degree of the patch printed on the printing sheet P is measured. It is determined whether or not the sedimentation state occurs in the glossy ink on the basis of the measurement result. When it is determined that the sedimentation state occurs, an operation for dissolving the sedimentation state is performed.

In the measurement of the gloss degree, first, the patch T1 (see FIG. 9) is printed on the printing sheet P by the glossy ink (Step S210). The printing (Step S210) of the patch P is performed in the same manner as Step S10 described above. That is, the printed patch T1 has a size in which at least a part of the patch T1 is formed by the ink in the ink supply tube 26. At the time of printing the patch T1, the positions of the plates of the valves 39 and 40 are changed to the ink supply position.

Then, the control unit 13 moves the carriage 8 and transports the printing sheet P such that the part of the patch T1 printed by the ink in the ink supply tube 26 is disposed on the optical path of the light emitted from the LED 70 (Step S220). The light is output from the LED 70, the light reflected from the patch T1 is received by the light receiving sensor 71, and the gloss degree of the patch T1 is measured on the basis of the light reception signal output from the light receiving sensor 71 (Step S230).

The gloss degree represents a ratio of the reflected light quantity to the light quantity of the light output from the LED 70 in the specularly reflected light output from the LED 70 and reflected from the patch T2. For example, an incidence light of the light output from the LED 70 and input to the patch T2 is set to 60°, and the gloss degree may be measured.

The control unit 13 configured as the gloss degree determining unit acquires the gloss degree on the basis of the light quantity for each wavelength area of the light output from the LED 70 and the light quantity of the light for each wavelength of the light received by the light receiving sensor 71. An integral value or an average value of the gloss degree for each wavelength is considered as the gloss degree of the patch T1 printed on the printing sheet P, and it is determined whether or not the patch T1 has a predetermined gloss degree on the basis of the gloss degree. Without acquiring the gloss degree for each wavelength, the gloss degree may be acquired on the basis of the light quantity of the light output from the LED 70 and the light quantity of the light received by the light receiving sensor 71. The light quantity for each wavelength area of the light output from the LED 70 is a predetermined value, and the light quantity of the light for each wavelength received by the light receiving sensor 71 may be acquired from the light reception signal output from the light receiving sensor 71. When the light output from the LED 70 is divided into visible light of RGB (red, green, and blue) using a filter and the light receiving sensor 71 is configured to obtain the light reception amount for each color light, an integral value or an average value of the gloss degree for each color light is a gloss degree.

When the sedimentation state occurs in the sedimentation ink in the ink supply tube 26, the gloss degree is low as compared with a case where the sedimentation state does not occur. That is, when the ink of a low concentration part of the contained component of the upper layer of the ink in the sedimentation state is ejected, and on the contrary when the ink of a high concentration of the contained component of the lower layer of the ink is ejected, the gloss degree may be decreased. Accordingly, the gloss degree when the patch T1 is printed by the glossy ink in which the sedimentation state does not occur is a predetermined value as a predetermined gloss degree, and is stored in the ROM 57. The predetermined gloss degree is compared with the measured gloss degree to determine whether or not the sedimentation state of the metallic ink occurs.

The predetermined value is, for example, 60%. When it is lower than this value, the stirring operation is performed. When the gloss degree is less than 60%, it may be presumed that the contained component of the glossy ink is sedimented, and the ink of the low concentration part of the contained component of the upper layer is ejected or the ink of the high concentration part of the contained component of the lower layer is ejected. The incidence angle for measuring the gloss degree, the wavelength of the light for measuring the gloss degree, or the predetermined value described above is an example for description, and actually, is appropriately determined by the roughness of the surface of the printing sheet P, the usage of the print, the contained component, and the like.

When the measured (Step S230) gloss degree is lower than a predetermined value, that is, when the gloss degree is not normal (Step S240: No), the stirring operation of stirring the glossy ink in the ink supply tube 26 is performed (Step S250). In the stirring operation (Step S250), the positions of the plates of the valves 39 and 40 are changed to the stirring position, and the liquid sending pump 38 is driven. When the liquid sending pump 38 is driven, the glossy ink is circulated between the ink supply tube 26 and the ink reflux tube 37, and it is possible to perform stirring of the glossy ink in the ink supply tube 26. Accordingly, it is possible to dissolve the sedimentation of the contained component of the glossy ink in the ink supply tube 26. The stirring operation (Step S250) is performed, for example, while the ink is circulated ten times between the ink supply tube 26 and the ink reflux tube 37.

When the measured shielding degree is not normal (Step S240: No), the sedimentation state of the glossy ink in the ink supply tube 26 may be reported to a user by a report unit that displays a message or generates an alarm sound, instead of performing the stirring operation (Step S250). By the reporting, the user may take measures such as instructing the printer 1 to perform the stirring operation of the ink.

After the stirring operation (Step S250) is completed, a patch T2 is printed by the same ink as the sedimentation ink by which the patch T1 is printed (Step S260), the movement of the carriage 8 and the transport of the printing sheet P are performed (Step S270), and the gloss degree of the patch T2 printed on the printing sheet P is measured (Step S280). The printing of the patch T2 (Step S260), the movement of the carriage 8 and the transport of the printing sheet P (Step S270), and the measurement of the gloss degree (Step S280) of the patch T2 are the same operations as the previous printing of the patch T1 (Step S210), the movement of the carriage 8 and the transport of the printing sheet P (Step S220), and the measurement of the gloss degree of the patch T1 portion (Step S230). The printing of the patch T2 (Step S260) is performed at a position different from that of the previous patch T1. In the printing of the patch T2 (Step S260), each position of the plates of the valves 39 and 40 are changed to the ink supply position.

After the stirring operation (Step S250) is completed, the printing of the patch T2 (Step S260) and the measuring of the gloss degree of the patch T2 portion (Step S280) are performed, and thus it is possible to determine whether or not the sedimentation state of the ink in the ink supply tube 26 is dissolved by the stirring operation (Step S250). When the measured gloss degree is lower than a predetermined value, that is, when the gloss degree is not normal (Step S290: No), possibility that the sedimentation state of the ink in the ink supply tube 26 is not dissolved is high according to the performing of the stirring operation (Step 250).

In this case (Step S290: No), a suction operation is performed (Step S300). The head 23 is moved out of the printing area where the ink suction mechanism 6 is disposed, and the suction operation is performed. The head 23 is sealed by the cap 34, the suction pump 35 is operated, and the ink in the nozzles and the ink supply tube 26 is discharged to the inside of the cap 34. Accordingly, the ink in the sedimentation state in the ink supply tube 26 is discharged, and it is possible to supply the ink in the ink tank 2 to the ink supply tube 26. In the dissolution of the sedimentation state, the stirring operation is performed before the suction operation of discharging the ink as waste ink is performed, and thus it is possible to suppress consumption of the ink as compared with the case of performing the dissolution of the sedimentation state only by the suction of the sedimentation ink.

When the measured gloss degree is not normal (Step S290: No), the sedimentation state of the sedimentation ink in the ink supply tube 26 may be reported to a user by a report unit that displays a message or generates an alarm sound, instead of performing the suction operation (Step S300). By the reporting, the user may take measures such as instructing the printer 1 to perform the suction operation of the ink.

After the suction operation (Step S300) is completed, a patch T3 is further printed by the same ink as the sedimentation ink by which the patches T1 and T2 are printed (Step S310), the movement of the carriage 8 and the transport of the printing sheet P are performed (Step S320), and the shielding degree of the patch T3 printed on the printing sheet P is measured (Step S330). The printing of the patch T3 (Step S310), the movement of the carriage 8 and the transport of the printing sheet P (Step S320), and the measurement of the gloss degree of the patch T3 (Step S330) are the same operations as the printing of the patch T1 (Step S210), the movement of the carriage 8 and the transport of the printing sheet P (Step S220), and the measurement of the gloss degree of the patch T1 (Step S230). The printing of the patch T3 (Step S310) is performed at a position different from those of the previous patches T1 and T2. In the printing of the patch T3 (Step S310), each position of the plates of the valves 39 and 40 are changed to the ink supply position.

After the suction operation (Step S300) is completed, the printing of the patch T3 (Step S310) and the measuring of the gloss degree of the patch T3 portion (Step S330) are performed, and thus it is possible to determine whether or not the sedimentation state of the ink in the ink supply tube 26 is dissolved by the suction operation (Step S300). When the measured gloss degree is lower than a predetermined value, that is, when the gloss degree is not normal (Step S340: Yes), possibility that the sedimentation state of the ink in the ink supply tube 26 is not dissolved is high according to the performing of the suction operation, in addition to the non-dissolution of the sedimentation state of the ink in the ink tank 2 (Step 300). In this case (Step S340: No), reporting is performed to a display unit or a sound generating mechanism (not shown) provided in the printer 1, by display or sound generation of possibility that the sedimentation occurs in the sedimentation ink in the ink tank 2 (Step S350). By the reporting of the reporting unit, it is possible to promote the user to take measures to dissolve the sedimentation of the ink in the ink tank 2. For example, the user who sees this displaying detaches the ink tank 2 from the printer 1, shakes the detached ink tank 2, or exchanges the ink tank 2 by new one.

In the determining of the gloss degree (Step S240, Step S290, and Step S340) described above, when it is determined that the gloss degree is equal to or more than a predetermined value (Steps S240, S290, and S340: Yes), it is considered that the ink in the ink supply tube 26 is not in the sedimentation state or the sedimentation state is dissolved, the operation of measuring the gloss degree and the sedimentation dissolution operation are completed, and the process is transferred to the normal printing operation.

However, when the light (ambient light) other than the light output from the LED 70 is input to the light receiving sensor 71, the light is a noise, and precision in measurement may be decreased. For this reason, it is preferable to provide a light shielding unit 72 around the light receiving sensor 71 so as not to input the ambient light to the light receiving sensor 71. The light shielding unit 72 is cylindrical, the light receiving sensor 71 is disposed in an inner circumference of the cylinder, and the ambient light is not easily input to the light receiving sensor 71.

As described above, in addition to the LED 10 and the light receiving sensor 11, the printer 1 includes the LED 70 as the second light emitting unit that emits the light from the printing face side to the patch T1 (T2 and T3), the light receiving sensor 71 as the second light receiving unit that receives the light emitted from the LED 70 and reflected from the patch T1 (T2 and T3), and the control unit 13 as the gloss degree determining unit that determines whether or not the patch T1 (T2 and T3) portion has a predetermined gloss degree on the basis of the light reception signal output from the light receiving sensor 71.

In the printing quality in the case of printing by the glossy ink, the gloss degree is a main assessment item. In the glossy ink, it is difficult to accurately determine the occurrence of the sedimentation state even when it is determined whether or not the sedimentation state occurs in the ink on the basis of the shielding degree. However, the printer 1 is configured to determine whether or not the sedimentation state occurs in the ink on the basis of the gloss degree as described above, and it is possible to improve the precision in determination whether or not the sedimentation state occurs in the glossy ink. When it is determined that the sedimentation state occurs, the sedimentation dissolution operation may be performed. Accordingly, even when the printing is performed by the glossy ink, it is possible to prevent the printing from being performed by the ink in the sedimentation ink. Even when the printer 1 can perform printing by both of the glossy ink and the sedimentation ink (hereinafter, referred to as non-glossy ink) other than the glossy ink in which the gloss degree is not high, as the sedimentation ink, it is possible to determine whether or not the sedimentation state occurs in both inks. When it is determined that the sedimentation state occurs, the sedimentation dissolution operation may be performed.

Other Embodiments

Figure 6:
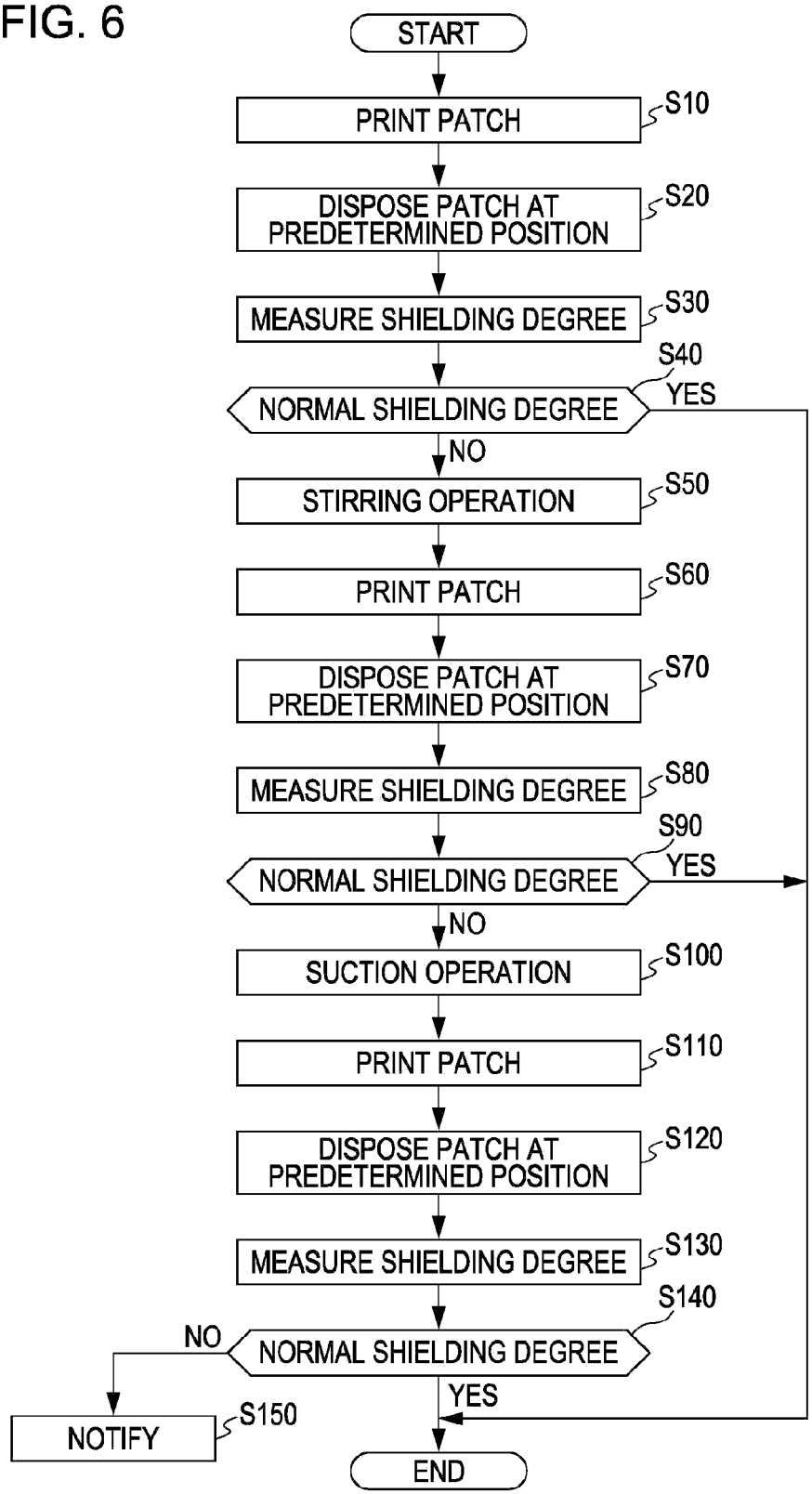
FIG. 6 is a flowchart schematically illustrating a shielding degree measuring operation and a sedimentation dissolution operation of the printer shown in FIG. 1.
Figure 10:
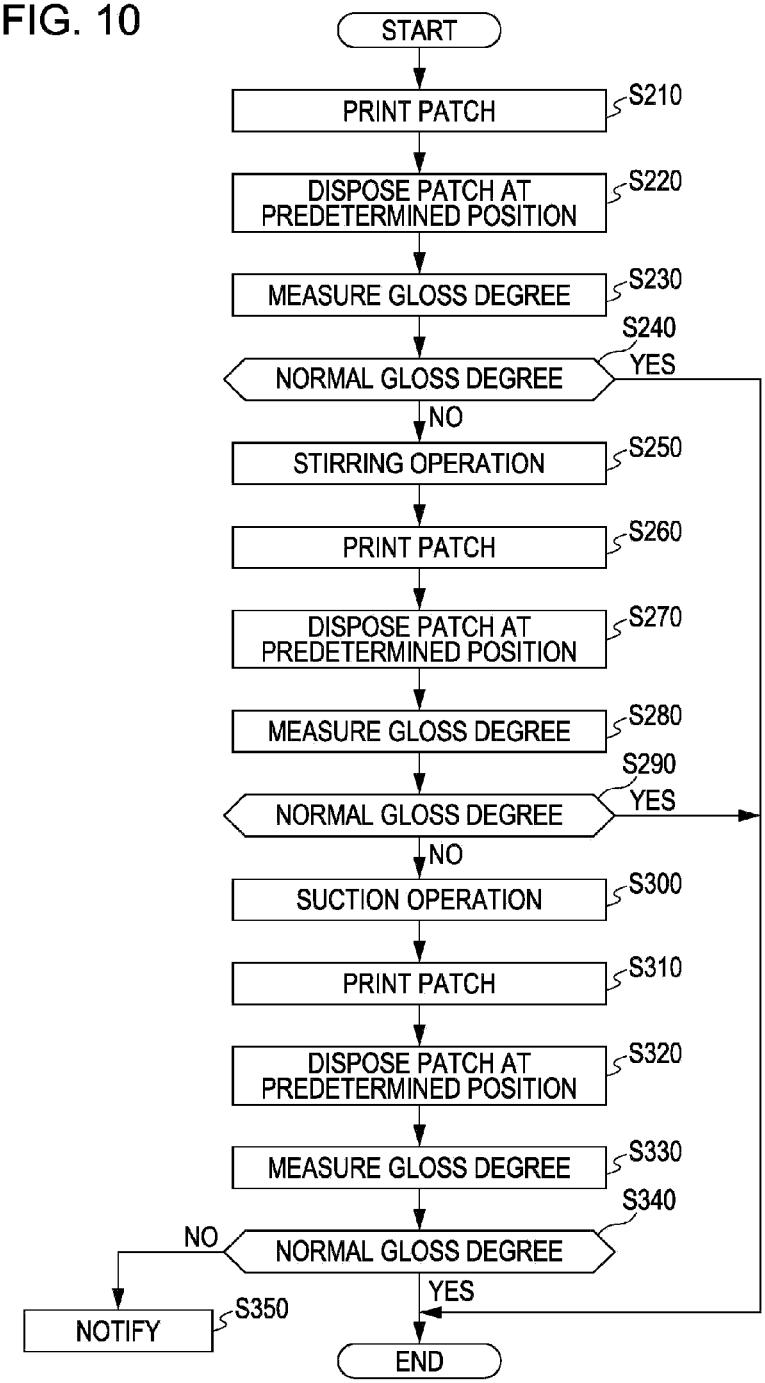
FIG. 10 is a flowchart schematically illustrating a gloss degree measuring operation and a sedimentation dissolution operation of the printer.

As described about the patch T1 (T2 and T3) with reference to FIG. 6 or FIG. 10, the printer 1 performs any one of measurements of the shielding degree and the gloss degree, and it is determined whether or not the sedimentation state occurs in the ink on the basis of the measurement result. In addition, both of the shielding degree and the gloss degree may be measured, and when the shielding degree is a value other than a predetermined value or the gloss degree is less than a predetermined value, the sedimentation dissolution operation may be performed. In the case of such a configuration, it is possible to improve the precision in determination whether or not the sedimentation state occurs, particularly, in the glossy ink. The measurement of the shielding degree and the measurement of the gloss degree are performed at different timings. When they are performed at the same timing, the light emitted from the LED 10 is input to the light receiving sensor 71, or on the contrary, the light emitted from the LED 70 is input to the light receiving sensor 11, and thus the precision in each measurement may be decreased.

For example, when the printing is performed on a transparent printing medium such as PET (Polyethylene terephthalate) and polyvinyl chloride, the printing medium easily allows the light to pass. Accordingly, when printing in which the sedimentation ink has a predetermined concentration (the state where the sedimentation state does not occur) is not performed, the printing quality is easily decreased such as the printing is transparent or a shade occurs in the printing. For this reason, it is necessary to improve the precision in determination whether or not the sedimentation state occurs in the ink, and to prevent the printing from being performed by the ink in the sedimentation state. From this viewpoint, the printer 1 that determines whether or not the sedimentation state of the ink occurs has high precision in determination of the sedimentation state of the sedimentation ink, and it is possible to improve the quality of printing by the sedimentation ink.

In a case of a printer in which a transport manner of the printing sheet P is a so-called center feeding manner of transporting the printing sheet P to the center in the left and right direction of the transport path, the printing of the patch is performed close to the center, and it is preferable that the light receiving sensor 11, the LED 70, and the light receiving sensor 71 are disposed to be collected at the center of the carriage 8 similarly to the printer 1 described above. With such a configuration, it is easy to print the patch and to measure the shielding degree and the gloss degree in the printed patch, irrespective of the size (a width in the left and right direction) of the sheet.

When a transport manner of the printing sheet P is a manner of transporting the printing sheet P to lean to one side of the left and right direction on the transport path, it is preferable that the printing of the patch is performed at a position close to the end portion of the side leaning to one side, and the light receiving sensor 11, the LED 70, and the light receiving sensor 71 are disposed at one position on the side where the carriage 8 leans to one side to easily measure the shielding degree and the gloss degree of the patch portion formed at the end portion. With such a configuration, it is easy to printing the patch and to measure the shielding degree and the gloss degree at the patch portion, irrespective of the size (a width in the left and right direction) of the sheet.

The printer 1 described in the embodiment feeds the printing sheet P from the sheet roll R, but may feed the printing sheet P of a single sheet type from a sheet tray or a sheet cassette.

In the printer 1 described in the embodiment, the paper gap adjusting mechanism 9 is provided with the light receiving sensor 11. In the measuring of the shielding degree, the carriage 8 approaches the printing sheet P by the paper gap adjusting mechanism 9, and the distance between the LED 10 and the light receiving sensor 11 is shortened. In the configuration in which the light receiving sensor 11 approaches and is separated from the LED 10, a dedicated mechanism for adjusting the distance from LED 10 may be provided without using the paper gap adjusting mechanism 9. However, the carriage 8 provided with the paper gap adjusting mechanism 9 is provided with the light receiving sensor 11, it is not necessary to provide a dedicated mechanism that changes the distance between the LED 10 and the light receiving sensor 11. For this reason, it is possible to simplify the structure and to reduce costs.

In the printer 1 described in the embodiment, the light output from the LED 10 and 70 is white, but is not limited to white light, and light requiring the shielding process or the gloss degree may be output according to the usage of the print.

In the printer 1 described in the embodiment, the light receiving sensor 11, the LED 70, and the light receiving sensor 71 are provided on the front face of the carriage 8, but may be disposed on the bottom of the carriage 8.

In the printer 1 described in the embodiment, the light receiving sensor 11 and the LED 10 are disposed at positions opposed to each other. However, even when the light receiving sensor 11 and the LED 10 are not opposed, it is sufficient that the light output from the LED 10 and passing through the patch T1 (T2 and T3) is input to the light receiving sensor 11. For example, when the light output from the LED 10 is guided to the light receiving sensor 11 using a reflection mirror or the like, the light receiving sensor 11 may not necessarily be disposed at the position opposed to the LED 10.

The printer 1 described in the embodiment is configured as a so-called serial printer as an example. However, the printer 1 may be configured as a printer using a so-called line head in which a printing width of the ink ejecting head in the main scanning direction is set to be greater than a width of the sheet in the main scanning direction.

In the embodiment, an example in which the liquid in which the contained component is sedimented with the lapse of time is the ink has been described, but the liquid is not limited to this ink.

In the embodiment, the light shielding degree and the gloss degree are measured using the printed patch, but the light shielding degree and the gloss degree may be measured on the basis of the image forming data.

The shielding degree and the gloss degree according to the amount of ink may be determined stepwise while changing the amount of ink for printing the patch.

The entire disclosure of Japanese Patent Application No. 2011-197982, filed Sep. 12, 2011 is expressly incorporated by reference herein.

What is claimed is:

1. A liquid ejecting apparatus ejecting a liquid in which a contained component is sedimented with the lapse of time, the liquid ejecting apparatus comprising:

a first light emitting unit that emits light to a measurement target portion on a printing medium;

a first light receiving unit that receives light emitted from the first light emitting unit and passing through the measurement target portion; and a shielding degree determining unit that determines a shielding degree of the measurement target portion on the basis of the first light receiving unit.

2. The liquid ejecting apparatus according to claim 1, wherein the first light emitting unit is disposed on a side separated further from the printing medium than a platen surface.

3. The liquid ejecting apparatus according to claim 1, further comprising:

a carriage moving unit that moves a carriage in a direction in which a distance from the printing medium is changed, a liquid ejecting head being mounted on the carriage; and a light shielding unit that reduces incidence of light to the first light receiving unit other than the light output from the first light emitting unit, wherein the first light receiving unit is mounted on the carriage.

4. The liquid ejecting apparatus according to claim 1, further comprising a sedimentation dissolution unit that dissolves a sedimentation of the liquid on a flow path from a liquid tank storing the liquid to a liquid ejecting head ejecting the liquid, wherein the sedimentation dissolution unit is driven according to the determination result of the shielding degree determining unit.

5. The liquid ejecting apparatus according to claim 1, further comprising:

a second light emitting unit that emits light from a printing face side to the measurement target portion;

a second light receiving unit that receives light emitted from the second light emitting unit and reflected from the measurement target portion; and a gloss degree determining unit that determines a gloss degree of the measurement target portion on the basis of the second light receiving unit.

6. A method of controlling a liquid ejecting apparatus ejecting a liquid in which a contained component is sedimented with the lapse of time, the method comprising:

printing a measurement target portion on a printing medium by the liquid; and determining a shielding degree of the measurement target portion on the basis of light passing through the measurement target portion where the liquid is printed.

7. A non-transitory computer readable storage medium in which a computer program for controlling a liquid ejecting apparatus ejecting a liquid in which a contained component is sedimented with the lapse of time is recorded, wherein the program causes the computer to:

print a measurement target portion on a printing medium by the liquid; and determine a shielding degree of the measurement target portion on the basis of light passing through the measurement target portion where the liquid is printed.

* * * * *